US006932655B2

(12) United States Patent
Hatterscheid et al.

(10) Patent No.: US 6,932,655 B2
(45) Date of Patent: Aug. 23, 2005

(54) ELECTRICAL PLUG CONNECTOR FOR INFORMATION TECHNOLOGY

(75) Inventors: Peter Hatterscheid, Bergisch Gladbach (DE); Siegfried Ruhr, Wiehl (DE); Konrad Brandsch, Gummersbach (DE); Ruediger Gelfarth, Gummersbach (DE)

(73) Assignee: Novar GmbH, Albstadt-Ebingen (DE)

( * ) Notice: Subject to any disclaimer, the term of this patent is extended or adjusted under 35 U.S.C. 154(b) by 0 days.

(21) Appl. No.: 10/384,778

(22) Filed: Mar. 11, 2003

(65) Prior Publication Data

US 2004/0002267 A1 Jan. 1, 2004

(30) Foreign Application Priority Data

Mar. 12, 2002 (DE) ..... 102 11 603

(51) Int. Cl.[7] ..... H01R 24/00
(52) U.S. Cl. ..... 439/676; 439/941
(58) Field of Search ..... 439/676, 941

(56) References Cited

U.S. PATENT DOCUMENTS

| | | | | |
|---|---|---|---|---|
| 5,362,257 A | * | 11/1994 | Neal et al. | 439/676 |
| 5,399,107 A | | 3/1995 | Gentry et al. | |
| 5,403,200 A | | 4/1995 | Chen | |
| 5,647,770 A | | 7/1997 | Belopolsky | |
| 5,697,817 A | * | 12/1997 | Bouchan et al. | 439/676 |
| 5,779,503 A | | 7/1998 | Tremblay et al. | |
| 5,911,602 A | | 6/1999 | Vaden | |
| 6,116,964 A | * | 9/2000 | Goodrich et al. | 439/676 |
| 6,120,330 A | | 9/2000 | Gwiazdowski | |
| 6,186,834 B1 | * | 2/2001 | Arnett et al. | 439/676 |
| 6,186,836 B1 | * | 2/2001 | Ezawa et al. | 439/676 |
| 6,217,392 B1 | | 4/2001 | Chen | |
| 6,267,628 B1 | * | 7/2001 | Meckley et al. | 439/676 |
| 6,328,609 B1 | * | 12/2001 | Ezawa et al. | 439/676 |
| 6,419,526 B1 | * | 7/2002 | Fair et al. | 439/676 |
| 6,764,348 B2 | * | 7/2004 | Han et al. | 439/676 |

FOREIGN PATENT DOCUMENTS

| | | |
|---|---|---|
| DE | 198 22 630 | 9/2000 |
| EP | 0782221 A2 | 7/1997 |
| EP | 0 955 703 | 11/1997 |
| GB | 2344470 A | 6/2000 |
| WO | WO 97/19499 | 5/1999 |

* cited by examiner

*Primary Examiner*—P. Austin Bradley
*Assistant Examiner*—X. Chung-Trans
(74) *Attorney, Agent, or Firm*—Crowell & Moring LLP

(57) ABSTRACT

An electrical plug connector for information technology purposes, in particular a RJ45 connector, is parallel with several contacts that are arranged in contact pairs. The contacts comprise each a terminal area, a contact section for the engagement with contacts of another electrical plug connector and a line section that connects the terminal area with the contact section, wherein the contact sections are arranged in parallel planes. All line sections run at least partially parallel to each other and in a joint plane. The line sections and the contact sections of each contact are arranged at an angle to each other and all contacts are bent in the same direction in the transition region between line section and contact section. The transition regions of contacts of different contact pairs have different progressions between the line section and contact section in the respective parallel planes.

17 Claims, 3 Drawing Sheets

ELECTRICAL PLUG CONNECTOR FOR INFORMATION TECHNOLOGY

BACKGROUND AND SUMMARY OF THE INVENTION

This application claims the priority of German Patent Document 102 11 603.2, filed Mar. 12, 2002, the disclosure of which is expressly incorporated by reference herein.

The invention relates to an electrical plug connector for information technology purposes, in particular a RJ45 connector, with several contacts that are arranged in at least three contact pairs. The contacts comprise each a terminal area, a contact section for the engagement with contacts of another electrical plug connector and a line section that connects the terminal area with the contact section. The contact sections are arranged in first planes that are parallel to each other. All line sections at least in some areas run parallel to each other and in a joint second plane. The line sections and the contact sections of each contact are arranged at an angle to each other and all contacts are bent in the same direction in the transition region between line section and contact section.

From U.S. Pat. No. 5,647,770 an insert for a RJ45 connector is known where the contacts of a contact pair are crossed in a horizontal direction. The contacts, respectively, contain terminal areas for connecting cables, contact sections for the engagement with the contact sections of a matching plug and a line section connecting the terminal areas with the contact sections. The contact sections are arranged in first planes that are parallel to each other. In the transition region of the line sections to the contact sections, a bend is provided arranging the contact sections at an angle of approximately 45° in relation to the line sections. In the horizontal direction, viewed parallel to the first parallel planes of the contact sections, the crossing of the contacts from the contact pair is symmetrical. In the vertical direction, viewed vertically to the parallel first planes, the crossed contacts are arranged in different planes so that the line sections do not overlap viewed in the vertical direction.

From U.S. Pat. No. 5,399,107 an insert for an RJ45 connector is known where cross-talk at high frequencies shall be reduced by increasing the distance and employing additional dielectric material between the individual contacts. For this, the line sections of adjacent contacts are arranged in different parallel planes, and the line sections run in guide grooves made of dielectric material.

U.S. Pat. No. 5,779,503 reveals an insert for a RJ45 connector where a total of four contact pairs are provided, wherein the contacts of three contact pairs are crossed. The crossing is placed in the transition region between the line sections and contact sections of the contacts. All three crossings are identical and symmetrical. The contact sections are located in parallel first planes and all in a joint plane that is vertical to the parallel planes. The contact sections are arranged at approximately a 45° angle in relation to the line sections, which are also arranged in a joint second plane. The crossings, which are located in a transition region between the line sections and contact sections, are fastened on one side by a plastic insert.

From German Patent Document DE 198 22 630 C1, an insert for an RJ45 connector is known where the contacts of a contact pair are crossed. The contacts each contain terminal areas, line sections and contact sections. The contact sections are arranged in first parallel planes and the line sections, at least partially, in a common second plane. The transition regions between line sections and contact sections are bent in opposite directions among different contact pairs.

U.S. Pat. No. 5,911,602 reveals another insert for a RJ45 connector where two different designs of contacts, corresponding to two different contact designs, are provided. The line sections run in a joint second plane, and between the contact sections and the line sections a transitional region is arranged, respectively, which in the two different contact designs take on different designs. In the first contact design the transition region has a first angle of 90° and a subsequent second angle of about 45°. In the second contact design the transition region has a first angle of about 135°, which is followed by an angle in the opposite direction of about 45° and finally by another angle in the opposite direction of about 50°. In total, only two different contact designs are provided in this design. The two different contact designs are used within one contact pair.

International Patent Publication WO 97/19499 shows an insert for a RJ45 plug where a total of two different contact designs are provided. Within one contact pair, the same contact design is used. The two different contact designs are accomplished by ensuring that the line sections of the contacts of a contact pair do not run in one plane with the remaining line sections. In these two line sections, the transition region between line section and contact section therefore has a different design in order to arrange the contact sections in another joint plane.

European Patent Document EP 0 955 703 A2 shows an insert for a RJ45 connector where two different contact designs are provided. Within one contact pair, two different contact designs are used. The line sections of all contacts run in one joint plane. The two different contact designs are realized by offsetting a transition region between the line sections and the contact sections in a direction parallel to the line sections.

From U.S. Pat. No. 6,217,392 B1 an insert for a RJ45 plug is known where the contacts in one region, in which the distance of the contacts among each other has been enlarged in part, are embedded in a plastic block. A crossing of contacts is not provided.

An aspect of the invention relates to an electrical plug connector for information technology purposes where with a simple design cross-talk between contact pairs is reduced even in the case of high transmission frequencies.

According to certain preferred embodiments of the invention, an electrical plug connector for information technology purposes is provided, in particular an RJ45 plug, comprising several contacts that are arranged in at least three contact pairs, each containing a terminal area, a contact section for engagement with contacts of another electrical plug connector, and a line section, which connects the terminal area with the contact section. The contact sections are arranged in first planes arranged parallel to each other. All line sections run parallel to each other at least in some areas and in a joint second plane. The line sections and the contact sections of each contact are arranged at an angle to each other, and all contacts in the transition region between the line section and the contact section are bent in the same direction, where the contacts have different designs for at least two different contact pairs. The transition regions of contacts for at least two different contact pairs have different progressions from each other between the line section and the contact section in the respectively first planes. The transition regions of contacts for at least two different contact pairs are arranged at a distance from each other in a direction that is parallel to the line sections.

By designing the contacts of at least two contact pairs differently, a clear improvement in the cross-talk behavior is achieved. By equipping the transition regions of at least two contact pairs with different progressions, the transition regions of different contact pairs are not aligned with each other between the contact sections and the line sections, reducing near-end cross-talk among contact pairs. Due to the fact that all transition regions are bent in the same direction and all line sections are arranged partially in one joint plane, an arrangement with accurate dimensions and low manufacturing costs is achieved. Furthermore the transition regions of at least two different contact pairs are arranged at a distance from each other in a direction parallel to the line sections and in the joint plane. This measure also prevents that the transition regions between the line sections and contact sections of different contact pairs are aligned with each other, thus reducing cross-talk between contact pairs. Pursuant to a beneficial development three different contact designs are provided in three different contact pairs, wherein the transition regions in three contact pairs are arranged at a distance from each other in a direction parallel to the line sections and/or the transition regions in three contact pairs have different progressions.

According to a further embodiment of the invention, the contacts of a contact pair are crossed in at least three contact pairs, wherein among different contacts pairs at least two different crossing angles are selected. These measures also improve the cross-talk behavior of the electrical plug connector, especially in the case of high transmission frequencies.

Yet another embodiment of the invention, the contact sections of different contact pairs are not arranged in one joint plane with a plugged-in, matching plug connector. Due to these measures, the contact sections of different contact pairs do not align with each other, both in the non-current-carrying state and when the plug is connected with the RJ45 connector, thus positively influencing the cross-talk behavior.

In certain embodiments of the invention, the contacts are fixed in a plastic insert by embedding at least the crossings of the contacts. This way the contacts can be safely fixed. In the area of the crossings, the distance settings of the contacts to each other are adhered to accurately and also the embedding process does not change that over the life of the electrical plug connector. In particular, the pre-determined distance settings are adhered to even when the contact sections are deflected by inserting a matching plug connector. The contacts in the area of the crossings can be molded for example. Molding the contacts occurs beneficially while producing the plastic insert within one operation.

In a further development of certain preferred embodiments of the invention, the plastic insert with the contacts can be inserted into a housing, wherein the plastic insert and/or the housing contains at least one snap-fit element for fixing the plastic insert in a pre-determined position in the housing. This measure allows the plastic insert to be mounted in a plastic housing in a simple fashion and be safely fastened thereto.

In a another development of certain preferred embodiments of the invention, the snap-fit elements are arranged in the area of a guide bead or a guide groove on the plastic insert. This further facilitates accurate assembly of the electrical plug connector.

An aspect of the invention also provides a plastic insert with contacts for an electrical plug connector pursuant to certain preferred embodiments of the invention.

Other objects, advantages and novel features of the present invention will become apparent from the following detailed description of the invention when considered in conjunction with the accompanying drawings.

DETAILED DESCRIPTION OF THE DRAWINGS

As shown in FIGS. 1–4, a total of eight contacts 1–8 can be seen. The contacts 1 and 2, the contacts 3 and 6, the contacts 4 and 5 as well as the contacts 7 and 8 form a contact pair, respectively.

Figure 1:
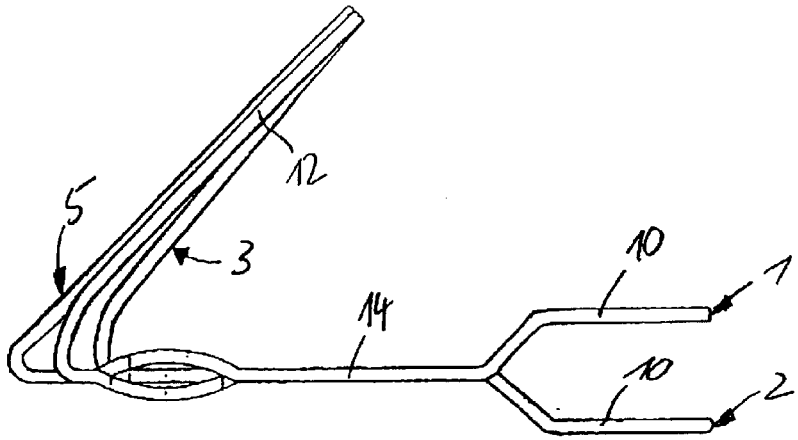
FIG. 1 shows a side view of contacts for a RJ45 plug pursuant to a first design of the invention.

Each contact 1 through 8 contains a terminal area 10 for connecting wires or for connecting a printed circuit board, a contact section 12 for engagement with the contacts of a matching RJ45 plug as well as a line section 14, which connects the respective terminal area 10 and the respective contact section 12 with each other. As shown in FIG. 1, the contact sections 12 are arranged at an angle of about 45° to the line sections 14. In the transition region between a line section 14 and a terminal area 10, the contacts are crimped, respectively, wherein the contacts are alternately crimped upward or downward. For example, in FIG. 1, the contact 1 is crimped upward, while the contact 2 is crimped downward. This increases the distance between the respective terminal areas 10 so that interaction between the contacts in the terminal area is reduced and remains limited to the sections of the contacts that run parallel to each other. In the design shown, several contacts are crossed over each other, namely contacts 1 and 2 of the first contact pair, contacts 4 and 5 of the third contact pair, and contacts 7 and 8 of the fourth contact pair.

Figure 2:
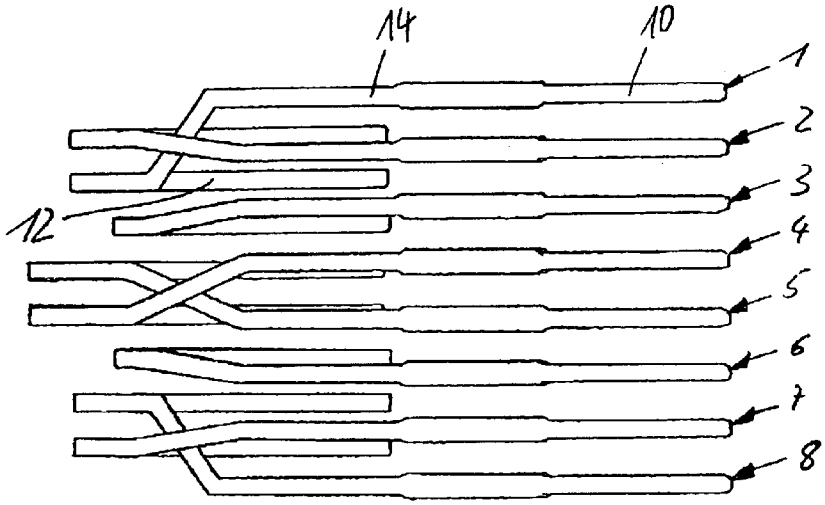
FIG. 2 shows a view from beneath of the contacts from FIG. 1.
Figure 3:
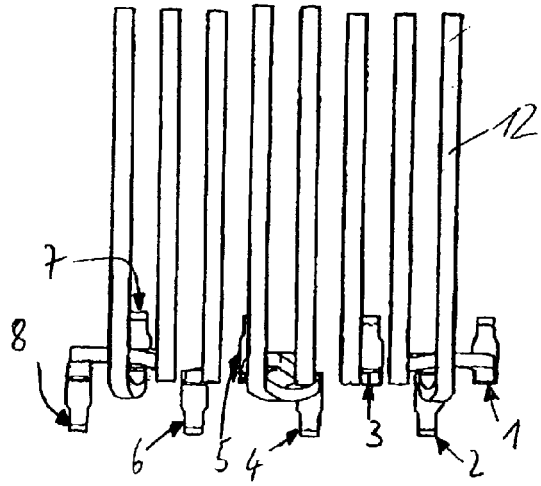
FIG. 3 shows a view from the front of the contacts from FIG. 1.
Figure 4:
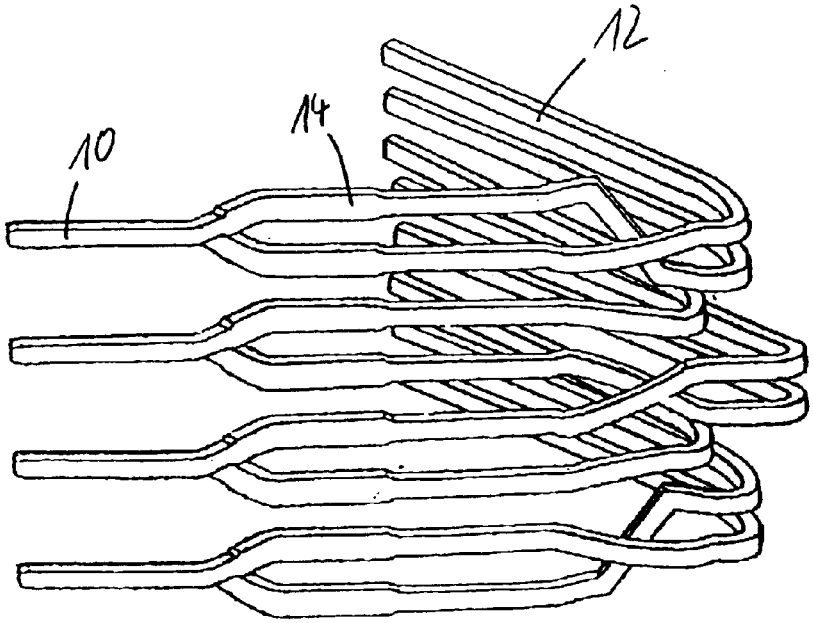
FIG. 4 shows a diagrammatic view from beneath at an angle of the contacts from FIG. 1.

FIGS. 2 and 3 show that all contact sections 12 run in first planes that are parallel to each other. FIG. 1 shows that all line sections 14 run partially in a joint second plane.

As shown in the view from beneath, as in FIG. 2, no two contacts run parallel in the area of the crossings of the contacts. Viewed in a direction vertical to the joint second plane, in which all line sections partially run parallel to each other, thus all line sections in the crossing region take on different angular positions. The crossing of contacts 4 and 5 takes on a different angle from the crossings of contacts 1 and 2 or 7 and 8 so that two different crossing angles exist. The crossings of contacts 1 and 2 or contacts 7 and 8 beyond that are not symmetrical, i.e., have neither a point-symmetric nor axially symmetric design. Beyond that, the crimped areas of the contacts 3 and 6 also have a different angular position than all other line sections in this area.

FIGS. 1 and 2 also show that the transition regions between the line sections 14 and the contact sections 12 have different designs among the different contact pairs and that these transition regions furthermore are arranged in an offset manner among the different contact pairs. For example, in a direction parallel to the line sections 14 and located in the joint plane of the line sections 14, the transition regions of contacts 3 and 6 of the second contact pair are arranged at a distance from the transition regions of the contacts 1 and 2 of the first contact pair and the transition regions of the contacts 7 and 8 of the fourth contact pair as well as the transition regions of contacts 4 and 5 of the third contact pair. Since the transition regions of the contacts 1 and 2 of the first contact pair and the transition regions of the contacts 7 and 8 of the fourth contact pair are also arranged at a distance in this direction from the transition regions of the contacts 4 and 5 of the third contact pair, the transition regions of the first, second and third contact pairs are not aligned in the view in FIG. 1. In the view in FIG. 1, only the transition regions of the first and the fourth contact pairs are aligned with each other.

As shown in FIG. 1, the transition regions of the first or fourth and the second and third contact pairs take on different designs. For example, the transition region of the contacts 4 and 5 of the third contact pair has a comparatively pointed angular design. By contrast, the transition regions of the contacts 1 and 2 as well as contacts 7 and 8 exhibit a rounded course. An even larger bending radius is shown by the transition regions of the contacts 3 and 6.

As shown in FIG. 1, in addition, the contact sections 12 of contacts 1, 2 or 7, 8 and the contact sections of contacts 3 through 6 are not located in one common plane. This is due to the above-described, differing positioning and design of the transition regions of the individual contact pairs. As shown, this applies to the non-current-carrying state of the contacts 1 through 8, depicted in FIG. 1. Due to the offset configuration of the transition regions of the individual contacts 1 through 8, however, this also applies to the current-carrying state of the contacts 1 through 8 when the contact areas 12 are pressed down by the contacts of a matching RJ45 plug. Due to the fact that the contact areas of the contact pairs are not aligned with each other even in the current-carrying state, the cross-talk behavior is influenced positively.

As shown in FIGS. 1–4, the contacts have different designs in all four contact pairs. Within each contact pair the contacts also have differing designs. The contacts 1 and 8, 2 and 7, as well as 3 and 6, are designed symmetrically to the center plane.

Figure 5:
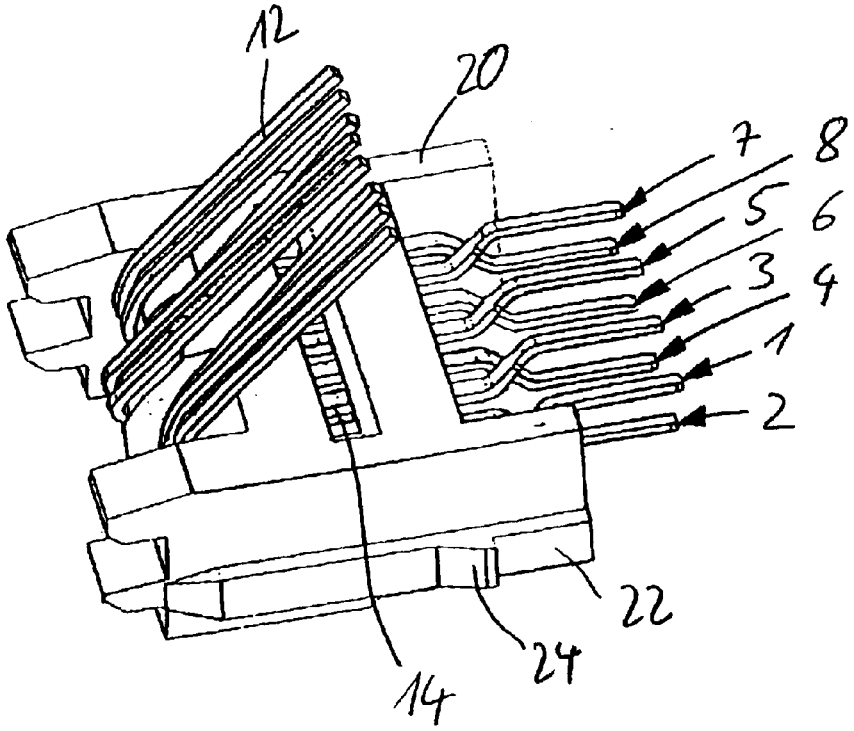
FIG. 5 shows a diagrammatic view of a plastic insert with the contacts from FIG. 1.

In the depiction in FIG. 5, the contacts 1–8 are arranged in a plastic insert 20. The contacts 1 through 8 are molded when producing the plastic insert 20 and thus embedded therein in sections. As shown in FIG. 5, the line sections 14 of the individual contacts are molded in the area of the crossings as well as in one additional area of the line sections 14. This way the contacts 1 through 8 are fixed safely and firmly in the plastic insert 20. The plastic insert 20 can be inserted into a housing, which contains a recess that matches a RJ45 plug.

The depiction in FIG. 5 reveals that the line sections of the individual contacts 1 through 8 are molded into the plastic insert 20, basically up to the transition region where the line sections transition into the contact sections 12. This way the crossings of the line sections 14 arranged in the vicinity of the transition region are located firmly in the plastic insert 20 and when deflecting the contact sections 12 the crossings as such remain stationary so that the already small distance in the area of the crossings cannot be reduced further.

In order to be able to introduce the plastic insert 20 safely and accurately into a housing, it is equipped on both sides with a guide bead 22, respectively. The guide beads 22 mesh with matching guide grooves in a housing 30, indicated with dotted lines in FIG. 6, and are equipped with a snap-fit nose 24, respectively. The snap-fit nose 24, which meshes with a matching recess in the housing 30, allows the plastic insert 20 with the contacts 1 through 8 to be locked safely in the housing.

Figure 6:
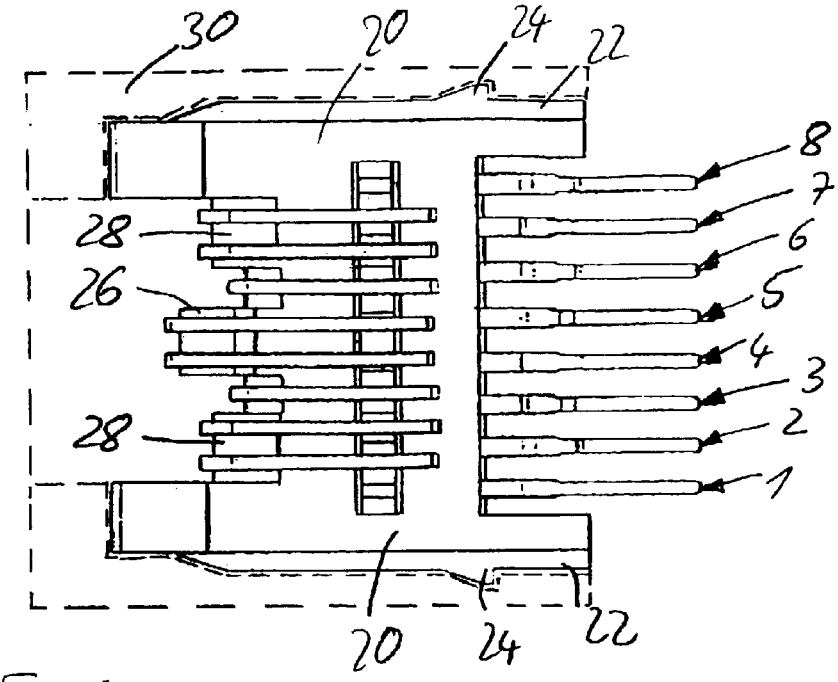
FIG. 6 shows a view from above of the plastic insert from FIG. 5.

In the top view in FIG. 6 onto the plastic insert 20 from FIG. 5, the two guide beads 22 as well as the snap-fit noses 24, which engage with the matching grooves or recesses in the housing 30, are clearly visible. Equally seen is that the line sections 14 are embedded into the plastic material of the plastic insert 20 directly up to the transition region of the contact sections 12. For this, the plastic insert 20 for example contains a lug 26, which extends beyond the transition region of the contacts 4 and 5. Viewed in the insertion direction of a matching plug, the plastic insert is recessed to the right and left of the lug 26 in order to also embed the contacts 3 and 6 only up to their crossing areas. Two protrusions 28 are provided on the plastic insert 20 in order to embed the contacts 1 and 2 or 7 and 8 up to their transition regions.

Figure 7:
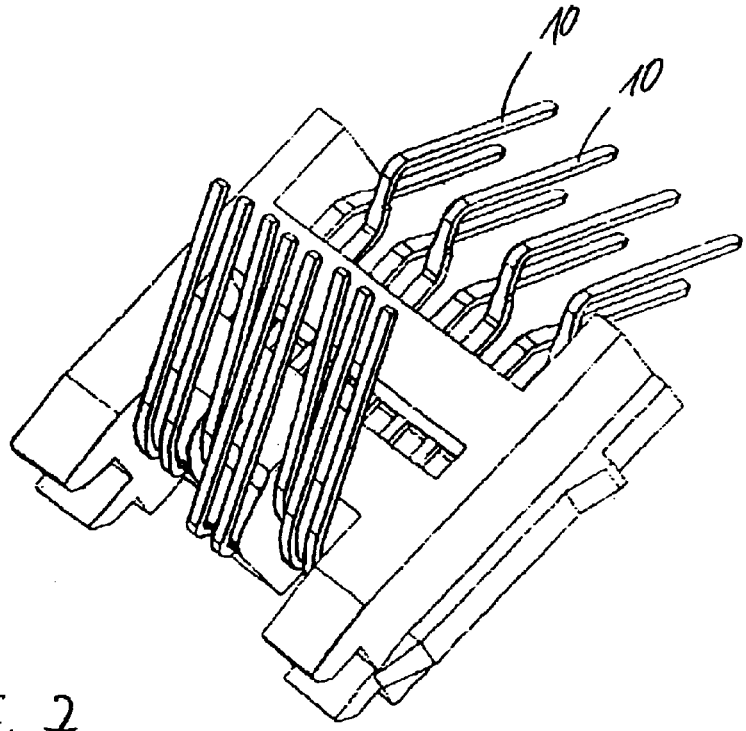
FIG. 7 shows a diagrammatic view of a plastic insert for an electrical plug connector pursuant to a second design of the invention.

In FIG. 7, another design of the invention is shown where, contrary to the design shown in FIGS. 1–6, only the terminal areas 10 of the individual contacts are angled. This way, the insertion direction of a RJ45 plug into the RJ45 socket from FIG. 7 can be, for example, at an angle to a board, into which the terminal areas 10 have been soldered. Apart from the angular position shown in FIG. 7, the terminal areas 10 can take on any random angular position and have an angle of for example 90° in order to achieve an insertion direction parallel to a board.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An electrical plug connector for information technology with several contacts arranged in contact pairs, with said contacts each comprising a terminal area, a contact section for engagement with contacts of another electrical plug connector, and a line section connecting the terminal area with the contact section, wherein the contact sections are arranged in first planes substantially parallel to each other, the line sections run at least partially parallel to each other and in a joint second plane, the line sections and the contact sections of each of the contacts are arranged at an angle to each other and the contacts are bent in substantially the same direction in a transition region between the line section and the contact section, and wherein the transition regions of the contacts in at least three different contact pairs between the line section and the contact section have different progressions in the respective first planes, and the transition regions of at least three differing contact pairs are arranged in a direction parallel to the line sections and at a distance from each other in the second plane.

2. The electrical plug connector according to claim 1, wherein the contacts of a contact pair in at least three contact pairs are crossed, and wherein between different contact pairs at least two different crossing angles are selected.

3. The electrical plug connector according to claim 2, wherein the contact sections of at least three different contact pairs are arranged in respective different planes when a matching connector is plugged in, in use.

4. The electrical plug connector according to claim 1, wherein the contact sections of at least three different contact pairs are arranged in respective different planes when a matching connector is plugged in, in use.

5. The electrical plug connector according to claim 1, wherein the contacts are fixed in a plastic insert by embedding at least crossings of the contacts.

6. The electrical plug connector according to claim 5 wherein the plastic insert with the contacts is designed to be inserted into a housing, and wherein the plastic insert or the housing contains at least one snap-fit element for fixing the plastic insert in a pre-determined position in the housing.

7. The electrical plug connector according to claim 6, wherein the snap-fit elements are arranged on the plastic insert in an area of a guide bead or guide groove.

8. A plastic insert for the electrical plug connector according to claim 5, comprising molded plastic portions to firmly locate the line sections in a vicinity of the respective transition regions.

9. The electrical plug connector according to claim 1, wherein the connector is a RJ45 connector.

10. A method of making the electrical plug connector of claim 1, comprising:

bending said contacts with respective different configurations, and molding the contacts to a plastic insert.

11. A method of using the electrical plug connector of claim 1, comprising inserting the plug connector in a device to transmit information.

12. The electrical plug connector according to claim 1, wherein the transition regions of the contacts of one of the contact pairs has a comparatively pointed angular design and the transition regions of the contacts of at least one other contact pair exhibit a rounded course.

13. The electrical plug connector according to claim 12, wherein, a total of four contact pairs are provided, wherein the contact sections have different designs for all four contact pairs, and wherein the contact sections in each contact pair have differing designs.

14. The electrical plug connector according to claim 1, wherein, a total of four contact pairs are provided, wherein the contact sections have different designs for all four contact pairs, and wherein the contact sections in each contact pair have differing designs.

15. An electrical plug connector for use as a RJ45 connector, comprising:

a plurality of contacts being arranged in contact pairs, the contacts each having a terminal area, a contact section for operatively engaging contacts of another connector and a line section connecting the terminal area with the contact section, the contact sections of the contact pairs being arranged in corresponding first planes, all of the line sections running parallel to each other in at least one area and in a joint second plane, the line sections and the contact sections of each of the contacts being arranged at an angle to each other, and the contact being bent in substantially the same direction in a transition region between the line section and the contact section, wherein the transition regions of at least three of said contact pairs have different transitions into the corresponding first planes, and wherein the transition regions of at least three of said contact pairs are arranged offset from one another by a distance in a direction parallel to the line sections.

16. An electrical plug connector for information technology with several contacts arranged in contact pairs, with said contacts each comprising a terminal area, a contact section for engagement with contacts of another electrical plug connector, and a line section connecting the terminal area with the contact section, wherein the contact sections are arranged in first planes substantially parallel to each other, the line sections run at least partially parallel to each other, the line sections and the contact sections of each of the contacts are arranged at an angle to each other and the contacts are bent in substantially the same direction in a transition region between the line section and the contact section, and wherein the transition regions of the contacts in at least three different contact pairs between the line section and the contact section have different progressions in the respective first planes, and the transition regions of at least three differing contact pairs are arranged in a direction parallel to the line sections and at a distance from each other.

17. An electrical plug connector for use as a RJ45 connector, comprising:

a plurality of contacts being arranged in contact pairs, the contacts each having a terminal area, a contact section for operatively engaging contacts of another connector and a line section connecting the terminal area with the contact section, the contact sections of the contact pairs being arranged in corresponding first planes, all of the line sections running parallel to each other in at least one area, the line sections and the contact sections of each of the contacts being arranged at an angle to each other, and the contact being bent in substantially the same direction in a transition region between the line section and the contact section, wherein the transition regions of at least three of said contact pairs have different transitions into the corresponding first planes, and wherein the transition regions of at least three of said contact pairs are arranged offset from one another by a distance in a direction parallel to the line sections.

* * * * *